US007044032B2

(12) United States Patent
Janson

(10) Patent No.: US 7,044,032 B2
(45) Date of Patent: May 16, 2006

(54) LOCKING PLIERS AND METHOD OF USE

(76) Inventor: Paul M. Janson, 19151 Tulsa St., Northridge, CA (US) 91326

( * ) Notice: Subject to any disclaimer, the term of this patent is extended or adjusted under 35 U.S.C. 154(b) by 0 days.

(21) Appl. No.: 10/864,738

(22) Filed: Jun. 10, 2004

(65) Prior Publication Data

US 2005/0274236 A1 Dec. 15, 2005

(51) Int. Cl.
*B25B 7/12* (2006.01)
*B25B 7/16* (2006.01)

(52) U.S. Cl. ..... 81/363; 81/367

(58) Field of Classification Search ..... 81/357–360, 81/363, 367–371, 381–386, 415–417
See application file for complete search history.

(56) References Cited

U.S. PATENT DOCUMENTS 2,320,303 A * 5/1943 Ross ..... 81/356
2,407,546 A * 9/1946 Gearhart ..... 81/306
2,481,866 A * 9/1949 Petersen ..... 81/356
2,500,462 A * 3/1950 Lazzarini ..... 81/363
2,905,038 A * 9/1959 Paden ..... 81/380
3,241,410 A * 3/1966 Paden ..... 81/370
3,672,245 A * 6/1972 Hoffman ..... 81/367
5,022,290 A * 6/1991 Duffy ..... 81/355
6,279,431 B1 * 8/2001 Seber et al. ..... 81/357
6,578,452 B1 * 6/2003 Duffy ..... 81/368
6,748,829 B1 * 6/2004 Seber et al. ..... 81/357

* cited by examiner

*Primary Examiner*—David B. Thomas
(74) *Attorney, Agent, or Firm*—Timothy Thut Tyson; Ted Masters; Freilich, Hornbaker & Rosen

(57) ABSTRACT

Locking pliers for grasping an object include a body and a sliding jaw member having a first jaw, the sliding jaw member slidably connected to a body wherein the sliding jaw member may be selectively positioned with respect to the body. A rotating jaw member has an integral second jaw and is rotatably connected to the body. A locking handle is also rotatably connected to the body, the locking handle combining with the rotating jaw member to form an over center mechanism. The sliding jaw member is slidably positioned so that the first and second jaws contact the object. Then the rotating jaw member and the locking handle are urged together activating the over center mechanism to firmly grasp the object.

9 Claims, 11 Drawing Sheets

LOCKING PLIERS AND METHOD OF USE

TECHNICAL FIELD

The present invention relates generally to the field of hand tools, and more particularly to locking pliers in which the jaws may be selectively spaced apart to accommodate objects of various sizes.

BACKGROUND OF THE INVENTION

Locking pliers are well known in the art. These devices typically include two jaws that may be locked about an object. The locking is effected by forcing two handles together wherein the handles cooperate to form an over center mechanism.

For example, U.S. Pat. No. 6,578,452 shows a vise grip locking tool that contains jaws that are capable of opening with a flick of the user's wrist. The tool comprises a first handle member, a second handle member, a lower jaw, and an upper jaw. The first handle member is pivotally attached to the lower jaw. The first end of the lower jaw is made up of four mutually interconnected sides having a guided slot extending through it. The upper jaw has an elongated shank that may slide along the guided slot of the lower jaw. A stop is present on the bottom of the shank preventing the upper jaw from escaping the guided slot. The second handle member is pivotally mounted to the lower jaw and includes a releasable lock which is made up of a spring operated detent which engages teeth on the elongated shank.

U.S. Pat. No. 5,357,829 illustrates pliers having opposed gripping tips thereon wherein each gripping tip is figured as a tooth that extends toward the opposite gripping tip.

U.S. Pat. No. 5,022,290 discloses a locking pliers wrench having a first handle member having a first jaw member lockable at a plurality of positions relative to the handle member and removable from the handle member. Different jaw members having different length shanks may be substituted. A second jaw member is pivotally mounted on and straddles the handle member.

U.S. Pat. No. 3,672,245 shows pliers for positively gripping a selected workpiece between substantially parallel gripping jaw surfaces. One of the jaw surfaces is carried by a fixed handle. The other is carried by a pivoted toggle member mounted on an extension of the fixed handle for pivotal movement and adjustment toward and away from the jaw surface on the fixed handle.

U.S. Pat. No. 3,241,410 consists of a combination quick set and vise grip wrench wherein toggle action levers in the handles pivotally urge an elongate shank and associated moveable jaw toward a stationary jaw with gripping action.

U.S. Pat. No. 2,905,038 describes a toggle wrench with slidable adjustment. The wrench comprises a vice grip or quick set type which employs an over center mechanism.

U.S. Patent Application Number U.S. 2003/0221523 depicts an adjustable pliers wrench including a fixture having a handle and an opposing stationary jaw, a coacting jaw pivoted to the fixture, and a lever pivoted to the coacting jaw. A guide is attached proximate the handle and a locking element is arranged on the guide for reciprocal and canting movement. At least one attached biasing element urges the locking element toward the stationary jaw. An arm is pivoted to the lever and a cam is pivoted to the arm and to the locking element so as to be movable between a first condition permitting the locking element to reciprocate along the guide and a second condition bearing against the guide and canting the locking element into frictional engagement against the guide.

BRIEF SUMMARY OF THE INVENTION

The present invention is directed to locking pliers for grasping an object. The present invention has certain features such as an over center mechanism which are common with vice grip type pliers. However, in the present invention the width of the object grasping jaws may be selectively adjusted to accommodate objects of different sizes.

In accordance with a preferred embodiment of the invention, locking pliers for grasping an object include a body formed of two plates. A sliding jaw member having a first object grasping jaw is slidably connected to the body wherein the sliding jaw member may be selectively positioned with respect to the body. A rotating jaw member has a handle portion and an integral second object grasping jaw, and is rotatably connected to the body. A locking mechanism is rotatably connected to the body, and in combination with the rotating jaw member forms an over center mechanism. The sliding jaw member may be slidably positioned so that the first jaw and the second jaw contact the object. The handle portion of the rotating jaw member and the locking handle are then urged together to activate the over center mechanism.

In accordance with an aspect of the invention, the sliding jaw member has a slot that slidably receives two spaced apart pins of the body.

In accordance with another aspect of the invention, the sliding jaw member has a plurality of positioning teeth, and a pawl is rotatably connected to the body. The pawl is movable between an engaged position wherein the pawl engages a space between two of the plurality of positioning teeth and a disengaged position. The pawl is biased by a pawl spring toward the engaged position.

In accordance with another aspect of the invention, the rotating jaw member includes a release stop, wherein the rotating jaw member is rotationally biased by a release spring so that the release stop contacts the pawl and urges the pawl into the disengaged position.

In accordance with another aspect of the invention, when the handle portion of the rotating jaw member and the locking handle are urged together, the rotating jaw member rotates so that the release stop disengages from the pawl thereby allowing the pawl to move to the engaged position.

In accordance with another aspect of the invention, the sliding jaw member includes a handle, which may be grasped to selectively slide the sliding jaw member with respect to the body so as to change the width of the object grasping jaws.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
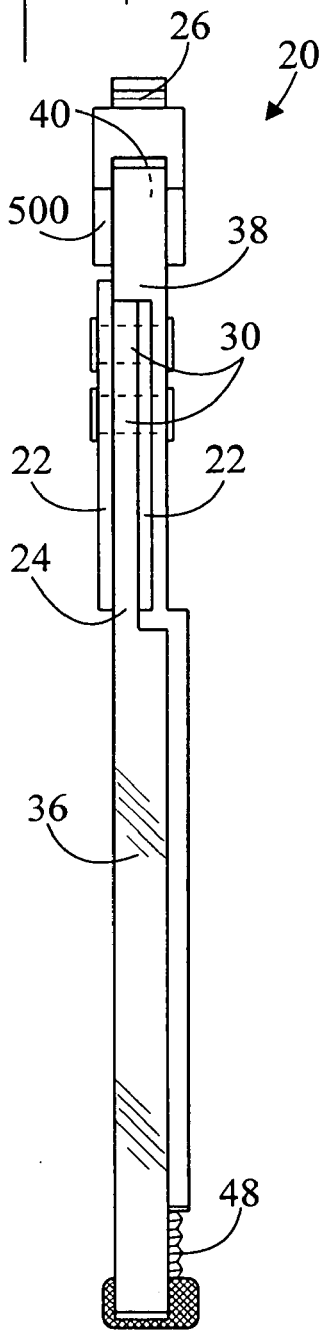
FIG. 1 is a front elevation view of locking pliers in accordance with the present invention.
Figure 2:
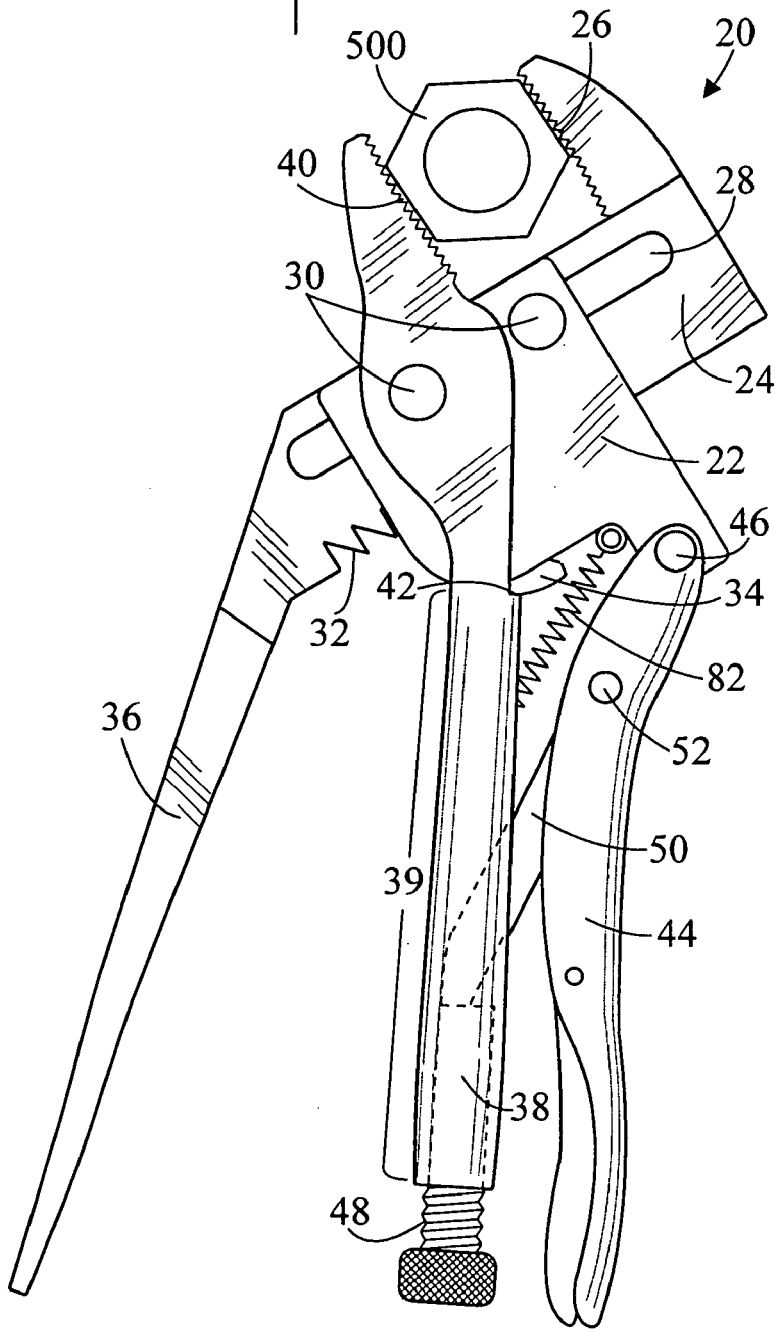
FIG. 2 is a side elevation view of the locking pliers.

FIGS. 1 and 2 illustrate front and side elevation views, respectively, of locking pliers for grasping an object in accordance with the present invention, generally designated as 20. Locking pliers 20 includes body 22 that comprises two spaced apart plates. Locking pliers 20 also includes a sliding jaw member 24 having a first object grasping jaw 26. Locking jaw member 24 is sandwiched between the two plates of body 22 (refer to FIG. 1). Sliding jaw member 24 is slidably connected to body 22 wherein sliding jaw member 24 may be selectively positioned with respect to body 22. Sliding jaw member 24 has a slot 28 that slidably receives two spaced apart pins 30 of body 22 wherein pins 30 engage slot 28. Sliding jaw member 24 has a plurality of positioning teeth 32, which may be engaged by a pawl 34 (refer to FIGS. 12–14 and the discussion pertaining thereto). Sliding jaw member 24 also has a handle 36 which may be grasped to selectively slide sliding jaw member 24 with respect to body 22 (refer to FIGS. 7 and 8).

Locking pliers 20 further includes a rotating jaw member 38 that has a handle portion 39 and an integral second object grasping jaw 40. It is noted that jaw 40 is integral with and a direct part of rotating jaw member 38 as opposed to the pivotally connected jaw shown in U.S. Pat. No. 6,578,452. In the shown embodiment, jaw 40 is offset to the left, and jaw 26 is correspondingly offset to the right (refer to FIG. 1). Rotating jaw member 38 is rotatably connected to body 22, and rotates about one of the pins 30. Rotating jaw member 38 also includes a release stop 42 (refer to FIGS. 12–14 and the discussion pertaining thereto). Rotating jaw member 38 is rotationally biased by being pulled in a counterclockwise direction in the shown embodiment by release spring 82 so that release stop 42 tends to urge pawl 34 into a disengaged position (refer to FIG. 13 and the discussion pertaining thereto).

Locking pliers 20 further include a locking handle 44 that is rotatably connected to body 22 and pivots about axis 46. Rotating jaw member 38 and locking handle 44 combine to form an over center mechanism. In the shown embodiment, the over center mechanism includes (1) an over center adjustment device 48 such as the screw shown disposed in rotating jaw member 38, and (2) an over center link 50 rotatably connected to locking handle 44 at axis 52. Over center link 50 contacts over center adjustment device 48 of rotating jaw member 38. This type of over center mechanism is well known in the art, and can be found in pliers of the vice grip type. In operation, sliding jaw member 24 is slidably positioned so that first jaw 26 and second jaw 40 contact an object 500. Rotating jaw member 38 and locking handle 44 are then urged together wherein the over center mechanism is activated to tighten the hold on object 500.

Figure 3:
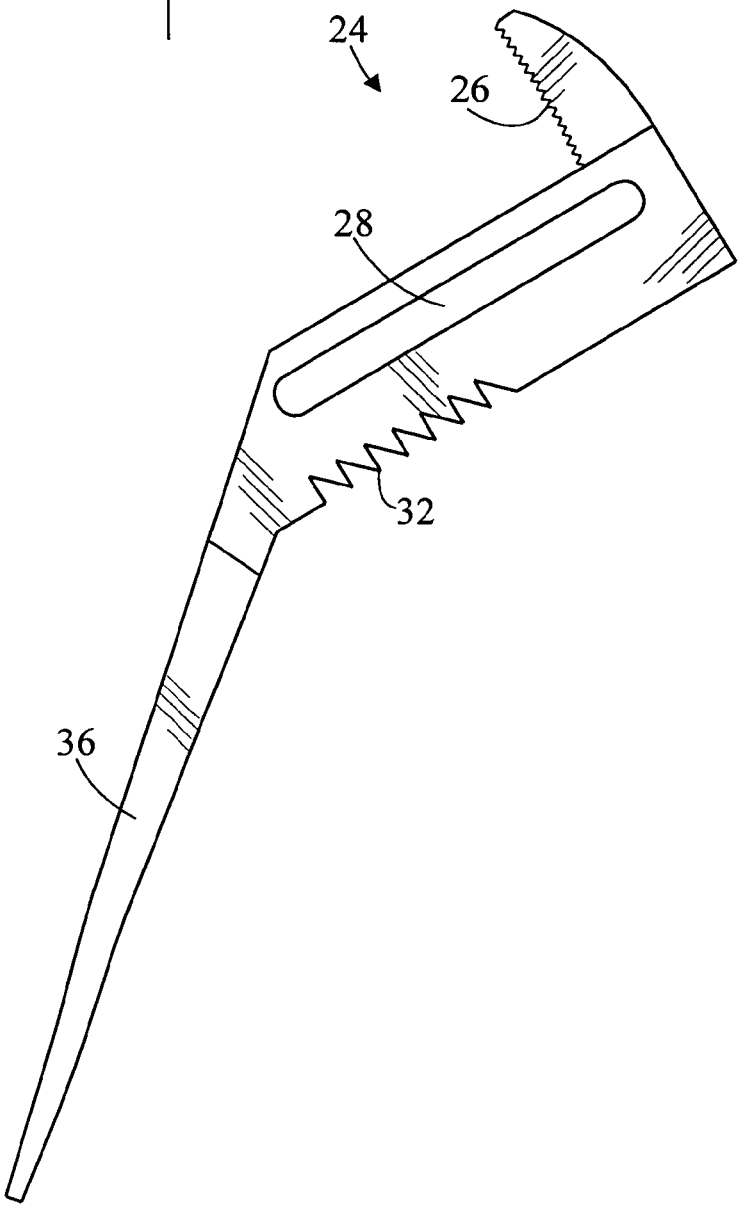
FIG. 3 is a side elevation view of a sliding jaw member.

FIG. 3 is a side elevation view of sliding jaw member 24 showing first jaw 26, slot 28, positioning teeth 32, and handle 36.

Figure 4:
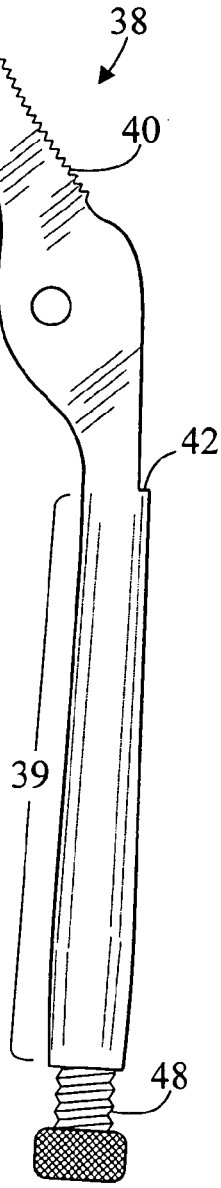
FIG. 4 is a side elevation view of a rotating jaw member.

FIG. 4 is a side elevation view of rotating jaw member 38 showing second teeth 40, handle portion 39, release stop 42, and over center adjustment device 48.

Figure 5:
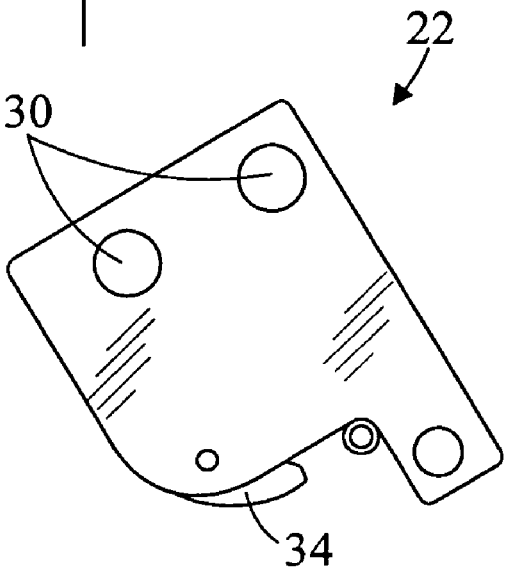
FIG. 5 is a side elevation view of a body.

FIG. 5 is a side elevation view of body 22 showing pins 30 and pawl 34.

Figure 6:
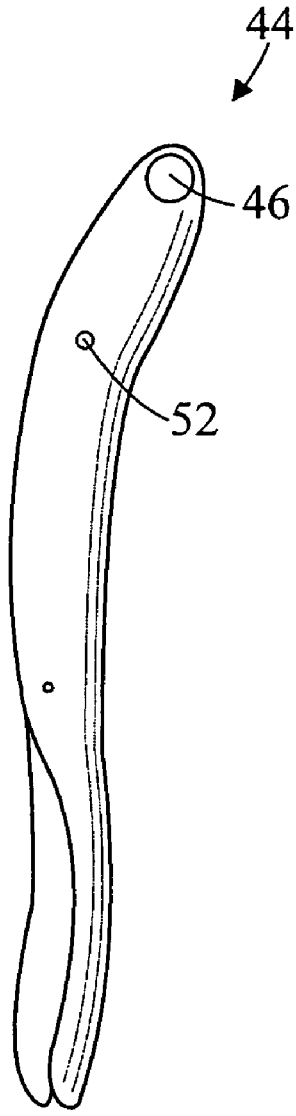
FIG. 6 is a side elevation view of a locking handle.

FIG. 6 is a side elevation view of locking handle 44 showing axes 46 and 52.

Figure 7:
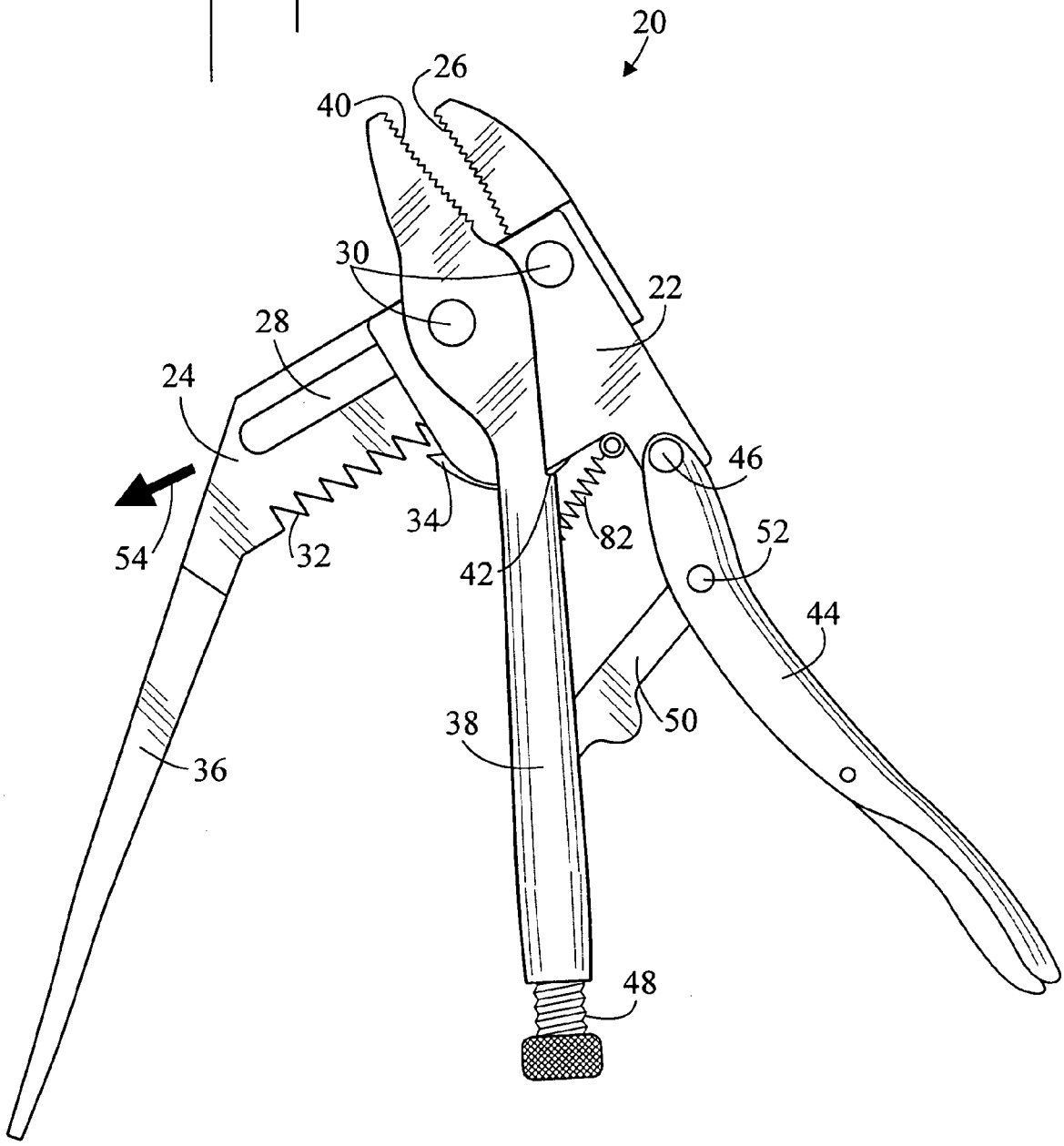
FIG. 7 is a side elevation view of the locking pliers in a fully closed position.

FIG. 7 is a side elevation view of locking pliers 20 in a fully closed position wherein sliding jaw member 24 has been slidably positioned in direction 54 so as to minimize the distance between first jaw 26 and second jaw 40.

Figure 8:
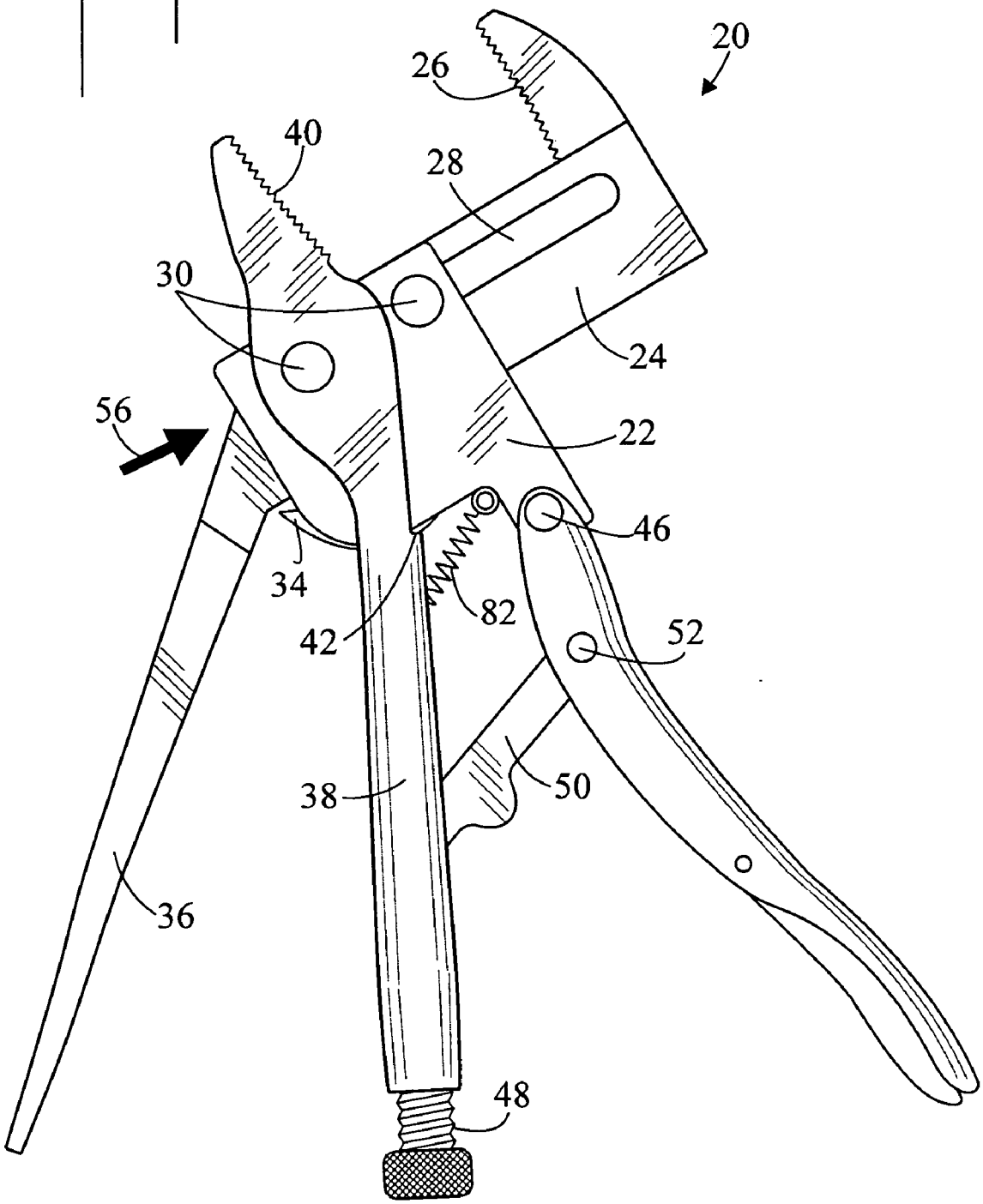
FIG. 8 is a side elevation view of the locking pliers in a fully open position.

FIG. 8 is a side elevation view of locking pliers 20 in a fully open position wherein sliding jaw member 24 has been slidably positioned in direction 56 so as to maximize the distance between first jaw 26 and second jaw 40.

Figure 9:
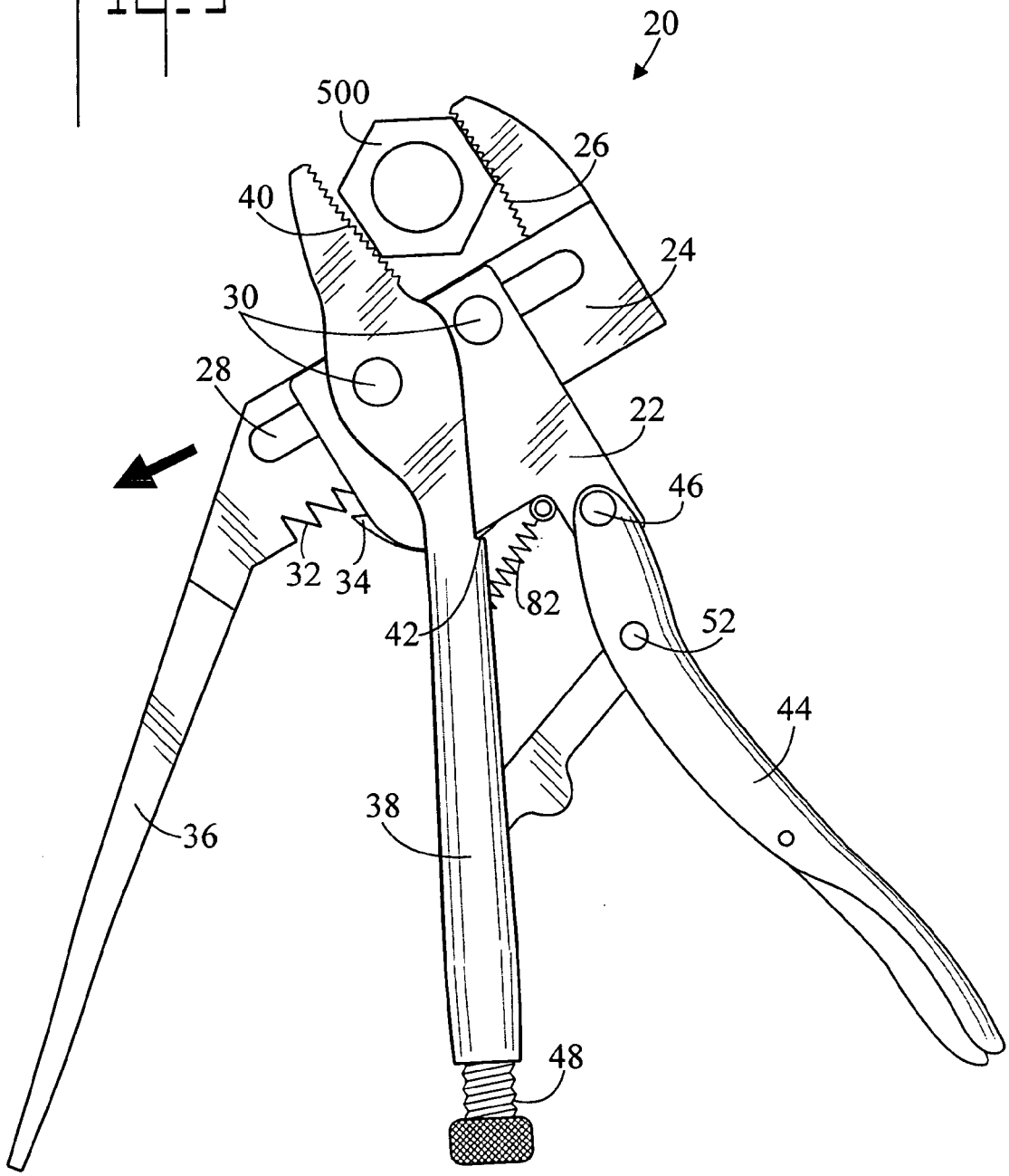
FIG. 9 is a side elevation view of the locking pliers wherein the sliding jaw member has been slidably positioned so that the jaws contact an object.

FIG. 9 is a side elevation view of locking pliers 20 wherein sliding jaw member 24 has been slidably positioned so that jaws 26 and 40 engage object 500 therebetween.

Figure 10:
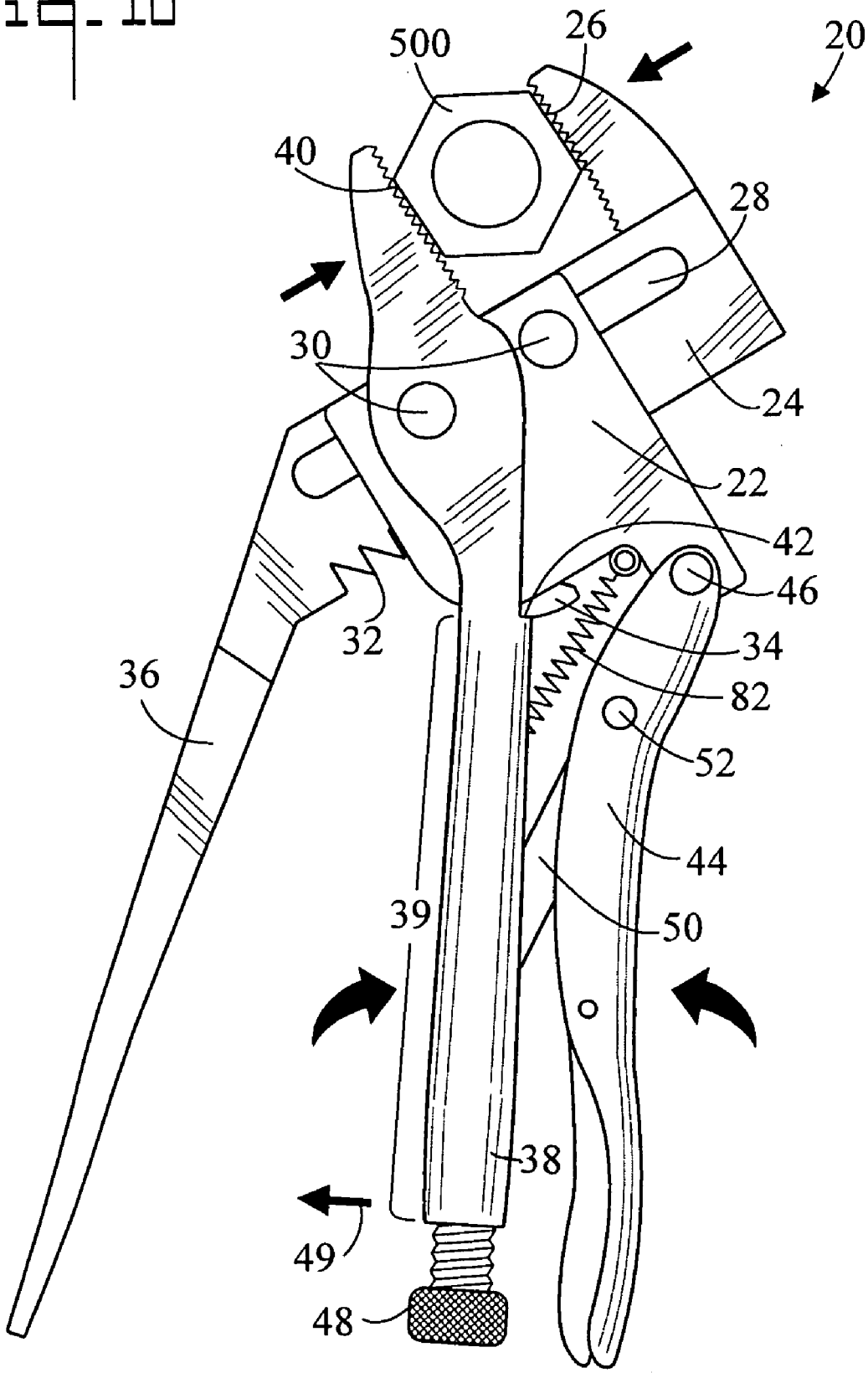
FIG. 10 is a side elevation view of the rotating jaw member and the locking handle urged together such as by grasping with one hand thereby activating the over center mechanism and locking the object in the jaws of the locking pliers.

FIG. 10 is a side elevation view of handle portion 39 of rotating jaw member 38 and locking handle 44 urged together such as by grasping with one hand thereby activating the over center mechanism and locking object 500 in the jaws 26 and 40 of locking pliers 20. It is noted that when handle portion 39 and locking handle 44 are urged together, over center link 50 causes jaw member 38 to rotate slightly in direction 49 toward handle 36 of sliding jaw member 24. This slight rotation overcomes the bias of release spring 82 and causes release stop 42 to disengage from pawl 34, thereby allowing pawl 34 to move to the engaged position wherein pawl 34 enters a space 35 between two of positioning teeth 32 in sliding jaw member 24 (refer also to FIG. 12 and the discussion pertaining thereto).

Figure 11:
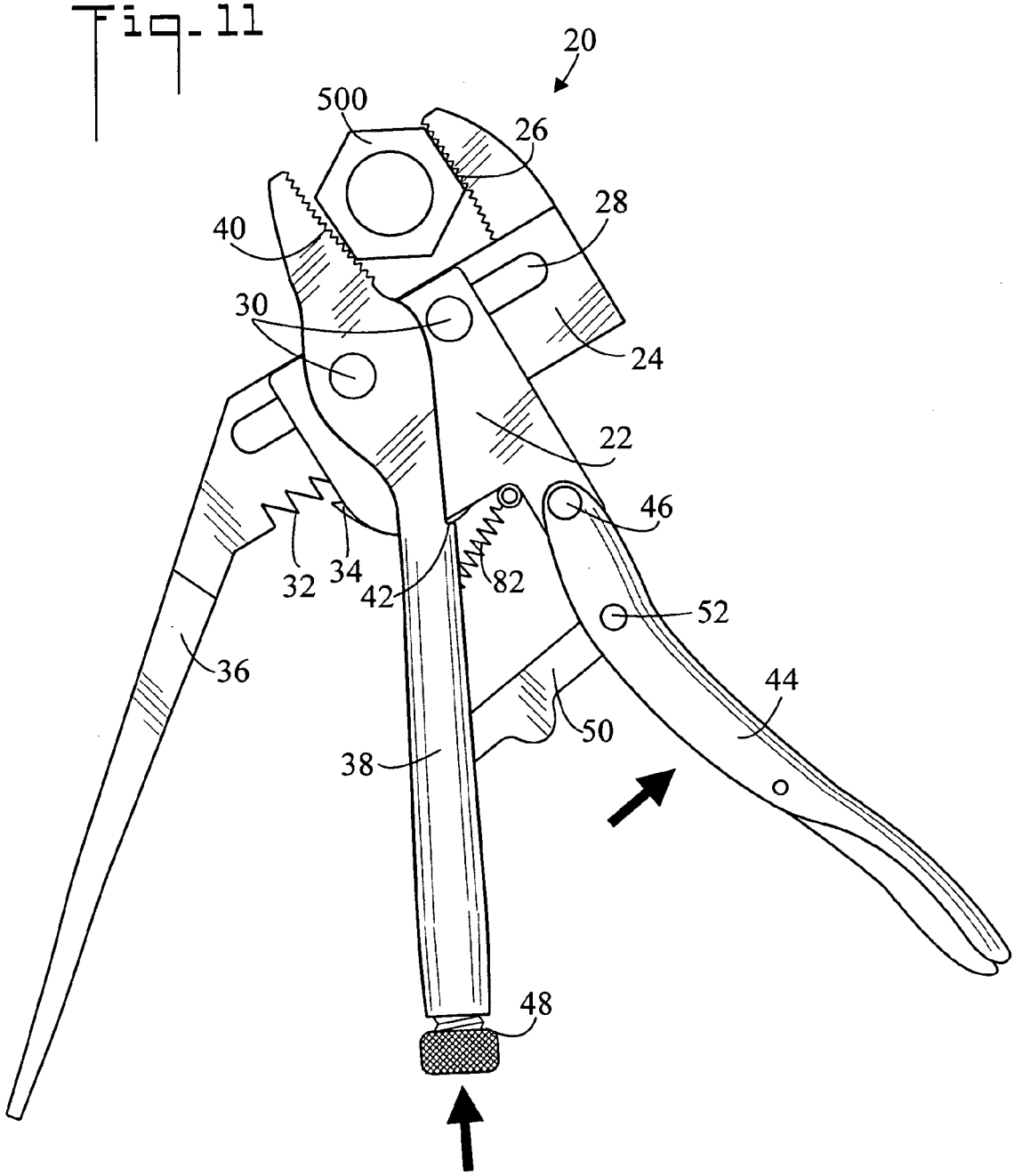
FIG. 11 is a side elevation view of the rotating jaw member showing the over center adjustment device being adjusted.

FIG. 11 is a side elevation view of rotating jaw member 38 showing over center adjustment device 48 being adjusted. By screwing adjustment device 48 toward or away from over center link 50, the force exerted by the over center mechanism upon an object maybe increased or decreased as is well known in the art.

Figure 12:
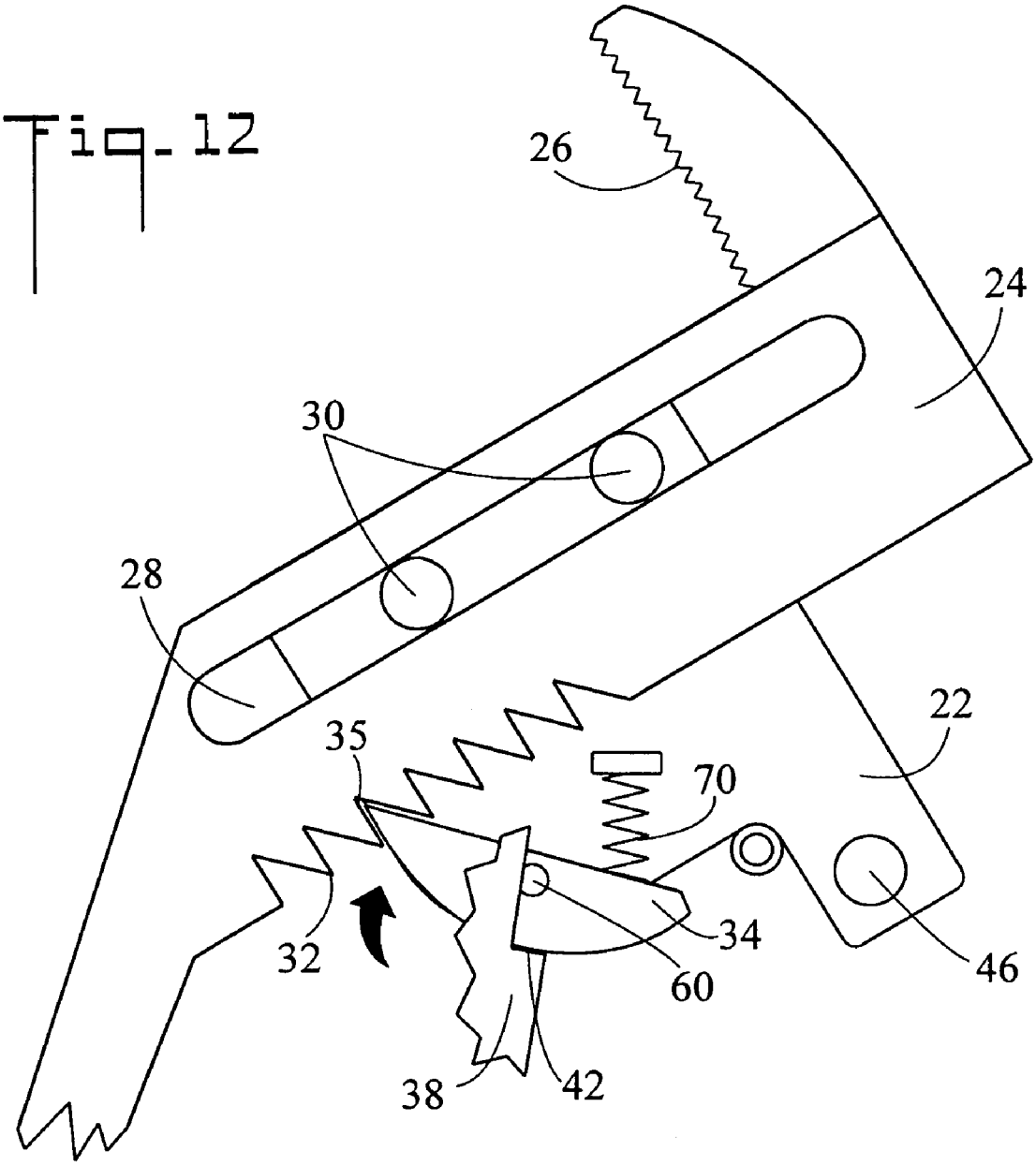
FIG. 12 is an enlarged fragmented cut away view showing a pawl in an engaged position.

FIG. 12 is an enlarged cut away fragmented view showing pawl 34 in an engaged position wherein pawl 34 enters space 35 between two of the plurality of positioning teeth 32 in sliding jaw member 24 (refer also to FIG. 10 and the discussion pertaining thereto). In this view the top plate of body 22 has been removed so that pawl 34 may be seen. Pawl 34 is rotatably connected to body 22 at axis 60, and is movable between an engaged position wherein pawl 34 enters space 35 between two of the plurality of positioning teeth 32 (refer to FIG. 12 and to FIGS. 1 and 10), and a disengaged position wherein pawl 34 does not engage any of plurality of positioning teeth 32 (refer to FIG. 13). In FIG. 12, pawl spring 70 biases pawl 34 by pushing it toward the engaged position.

Figure 13:
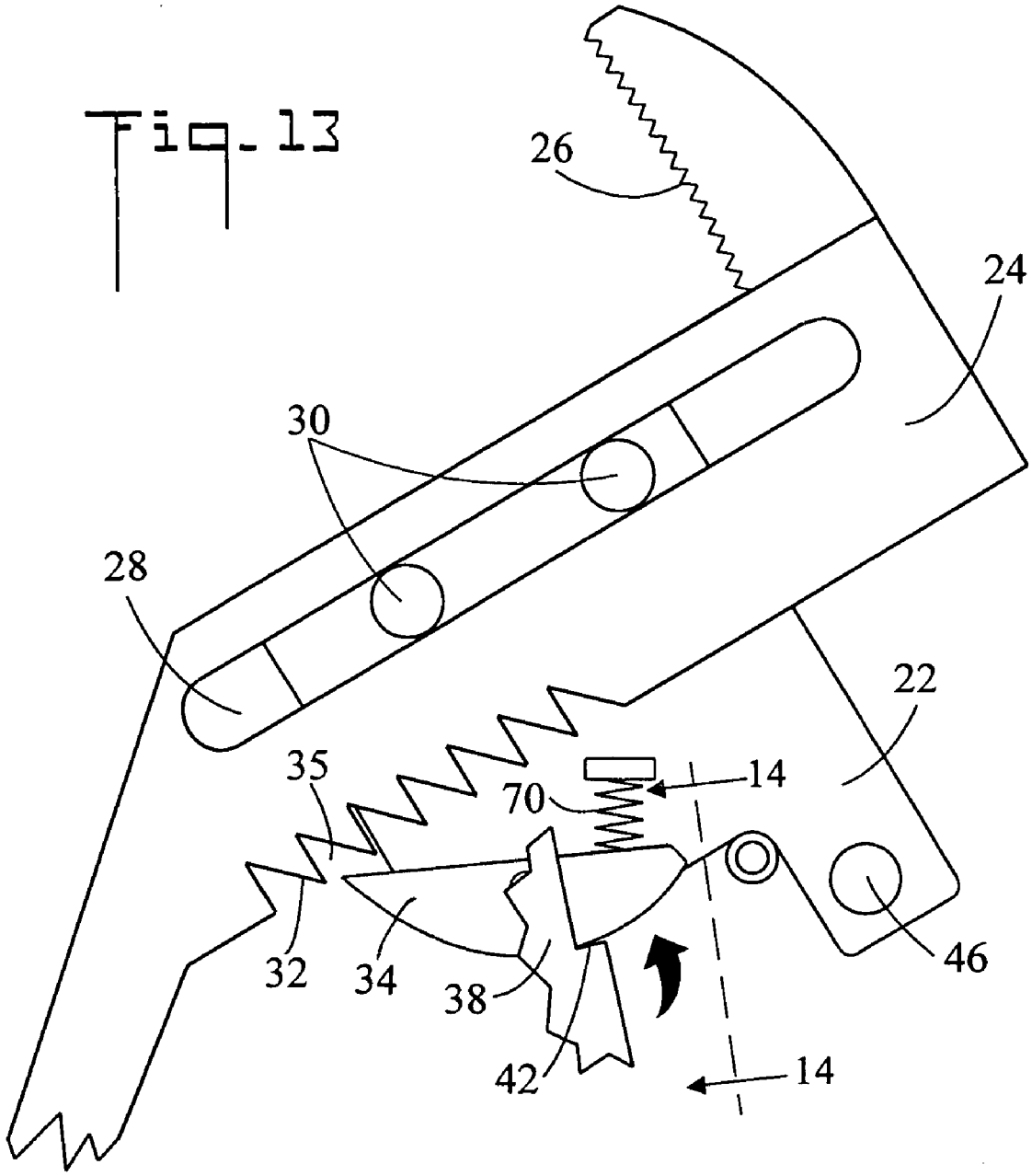
FIG. 13 is an enlarged fragmented cut away view showing the pawl in a disengaged position.

FIG. 13 is an enlarged cut away fragmented view showing pawl 34 in a disengaged position. Rotating jaw member 38 is rotationally biased by release spring 82 (refer to FIG. 1) so that release stop 42 contacts pawl 34 and urges pawl 34 into the disengaged position (refer also to FIGS. 7, 8, 9, and 11). In the disengaged position, sliding jaw member 24 may be freely positioned with respect to body 22.

Figure 14:
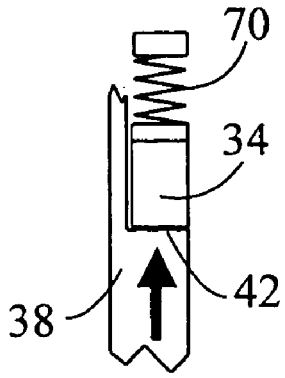
FIG. 14 is a view along the line 14—14 of FIG. 13.

FIG. 14 is a view along the line 14—14 of FIG. 13 showing release stop 42 urging pawl 34 into the disengaged position.

Figure 15:
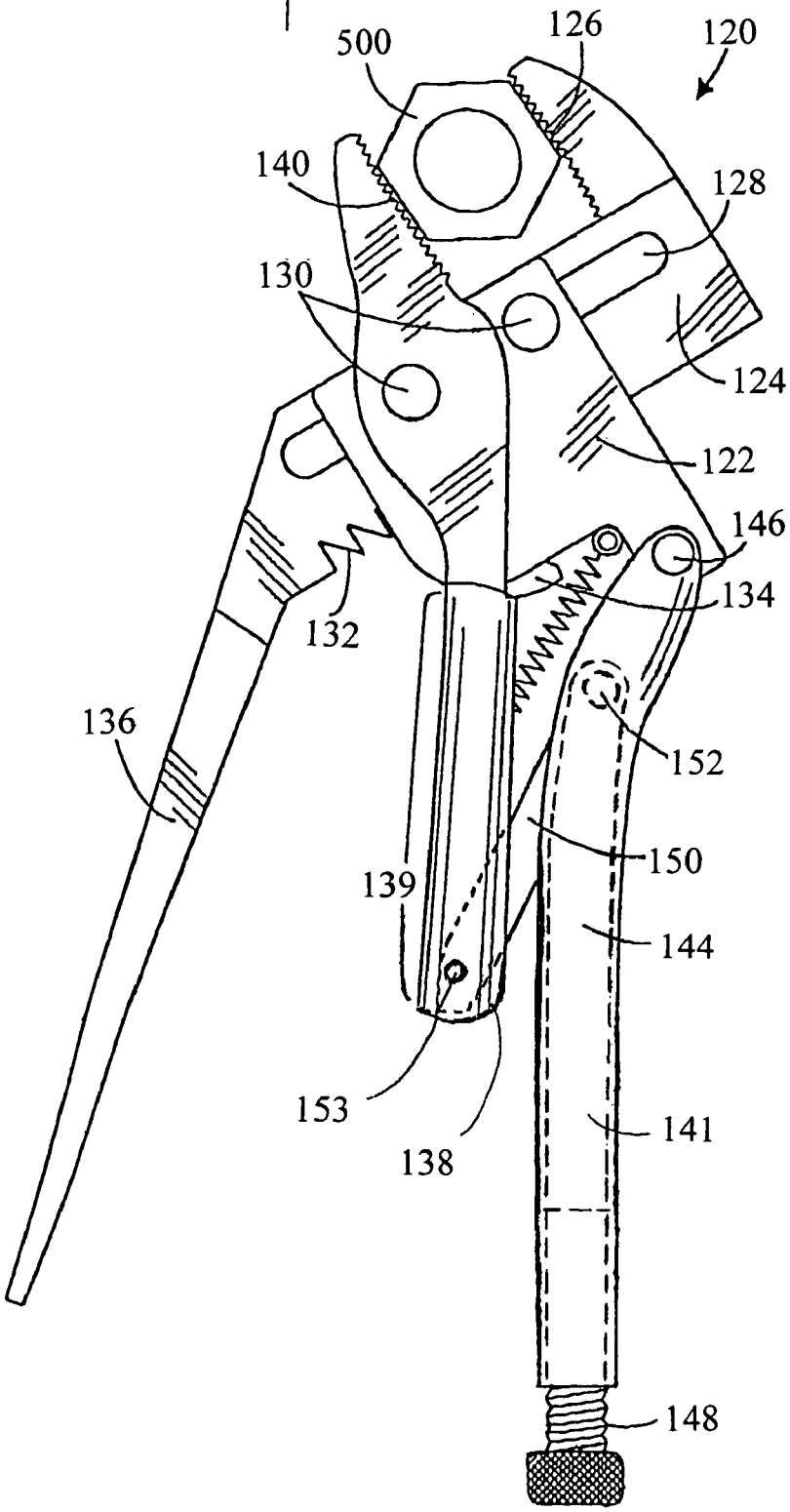
FIG. 15 is a side elevation view of a second embodiment.

FIG. 15 is a side elevation view of a second embodiment of the locking pliers, generally designated as 120. Locking pliers 120 includes body 122 that comprises two spaced apart plates. A sliding jaw member 124 having a first object grasping jaw 126 is sandwiched between the two plates of body 122. Sliding jaw member 124 is slidably connected to body 122 wherein sliding jaw member 124 may be selectively positioned with respect to body 122. Sliding jaw member 124 has a slot 128 that slidably receives two spaced apart pins 130 of body 122 wherein pins 130 engage slot 128. Sliding jaw member 124 has a plurality of positioning teeth 132, which may be engaged by a pawl 134. Sliding jaw member 124 also has a handle 136 which may be grasped to selectively slide sliding jaw member 124 with respect to body 122. A rotating jaw member 138 has a handle portion 139 and an integral second object grasping jaw 140. Rotating jaw member 138 rotates about one of the pins 130. A locking handle 144 is rotatably connected to body 122 and pivots about axis 146. Rotating jaw member 138 and locking handle 144 combine to form an over center mechanism. In this second embodiment, the over center mechanism includes (1) an over center adjustment device 148 such as a screw shown disposed in locking handle 144, (2) a movable adjustment link 141 which slides inside locking handle 144 rotatably coupled to over center adjustment device 148, and (3) an over center link 150 rotatably coupled to movable adjustment link 141 at axis 152 and to rotating jaw member 138 at axis 153. The jaws of the locking pliers 120 are locked when axis 152 moves past a straight line between axes 146 and 153 in the direction of the jaws in a manner well known in the art. In operation, sliding jaw member 124 is slidably positioned so that first jaw 26 and second jaw 140 contact an object 500. Over center adjustment device 148 is adjusted so the jaws will lock on object. Rotating jaw member 138 and locking handle 144 are then urged together wherein the over center mechanism is activated to tighten the hold on object 500. All other elements of the second embodiment are the same as the elements in the first embodiment and work in the same manner as in the first embodiment.

In terms of use, a method for grasping an object includes:

(a) providing an object 500;

(b) providing locking pliers 20 including:

a body 22;

a sliding jaw member 24 having a first jaw 26, the sliding jaw member 24 slidably connected to body 20, the sliding jaw member 24 having a handle 36 wherein handle 36 may be used to selectively position sliding jaw member 24 with respect to body 22;

a rotating jaw member 38 having an integral second jaw 40, rotating jaw member 38 rotatably connected to body 22;

a locking handle 44 rotatably connected to body 22; and, rotating jaw member 38 and locking handle 44 combining to form an over center mechanism;

(c) grasping handle 36 of sliding jaw member 24 with one hand and rotating jaw member 38 with the other hand;

(d) sliding jaw member 24 with respect to body 22 so that first jaw 26 and second jaw 40 contact object 500; and, (e) urging handle portion 39 of rotating jaw member 38 and locking handle 44 together wherein the over center mechanism is activated.

The preferred embodiments of the invention described herein are exemplary and numerous modifications, variations, and rearrangements can be readily envisioned to achieve an equivalent result, all of which are intended to be embraced within the scope of the appended claims.

I claim:

1. Locking pliers for grasping an object, comprising:

a body;

a sliding jaw member having a first jaw, said sliding jaw member slidably connected to said body wherein said sliding jaw member may be selectively positioned with respect to said body;

a rotating jaw member having a handle portion and an integral second jaw, said rotating jaw member rotatably connected to said body;

a locking handle rotatably connected to said body;

said rotating jaw member and said locking handle combining to form an over center mechanism; and, wherein said sliding jaw member may be slidably positioned so that said first jaw and said second jaw contact the object, and then said handle portion of said rotating jaw member and said locking handle are urged together by grasping with one hand to activate said over center mechanism.

2. Locking pliers according to claim 1, further including:

said over center mechanism including (1) an over center adjustment device disposed in said locking handle, (2) a movable adjustment link in said locking handle coupled to said over center adjustment device, and (3) an over center link rotatably coupled to said movable adjustment link and said rotating jaw member.

3. Locking pliers for grasping an object, comprising:

a body;

a sliding jaw member having a first jaw, said sliding jaw member slidably connected to said body wherein said sliding jaw member may be selectively positioned with respect to said body;

a rotating jaw member having a handle portion and an integral second jaw, said rotating jaw member rotatably connected to said body;

a locking handle rotatably connected to said body;

said rotating jaw member and said locking handle combining to form an over center mechanism;

wherein said sliding jaw member may be slidably positioned so that said first jaw and said second jaw contact the object, and then said handle portion of said rotating jaw member and said locking handle are urged together to activate said over center mechanism;

said sliding jaw member having a slot that slidably receives said body; and, said body including two spaced apart pins which slidably engage said slot.

4. Locking pliers for grasping an object, comprising:

a body;

a sliding jaw member having a first jaw, said sliding jaw member slidably connected to said body wherein said sliding jaw member may be selectively positioned with respect to said body;

a rotating jaw member having a handle portion and an integral second jaw, said rotating jaw member rotatably connected to said body;

a locking handle rotatably connected to said body;

said rotating jaw member and said locking handle combining to form an over center mechanism;

wherein said sliding jaw member may be slidably positioned so that said first jaw and said second jaw contact the object, and then said handle portion of said rotating jaw member and said locking handle are urged together to activate said over center mechanism;

said sliding jaw member having a plurality of positioning teeth;

a pawl rotatably connected to said body;

said pawl movable between an engaged position wherein said pawl enters a space between two of said plurality of positioning teeth and a disengaged position; and, said pawl biased toward said engaged position.

5. Locking pliers according to claim 4, further including:

said rotating jaw member including a release stop; and, wherein said rotating jaw member is rotationally biased so that said release stop contacts said pawl and urges said pawl into said disengaged position.

6. Locking pliers according to claim 4, further including:

said rotating jaw member including a release stop; and, when said handle portion of said rotating jaw member and said locking handle are urged together, said rotating jaw member rotating so that said release stop disengages from said pawl thereby allowing said pawl to move to said engaged position.

7. Locking pliers for grasping an object, comprising:

a body;

a sliding jaw member having a first jaw, said sliding jaw member slidably connected to said body wherein said sliding jaw member may be selectively positioned with respect to said body;

a rotating jaw member having a handle portion and an integral second jaw, said rotating jaw member rotatably connected to said body;

a locking handle rotatably connected to said body;

said rotating jaw member and said locking handle combining to form an over center mechanism;

wherein said sliding jaw member may be slidably positioned so that said first jaw and said second jaw contact the object, and then said handle portion of said rotating jaw member and said locking handle are urged together to activate said over center mechanism; and, said sliding jaw member including a handle which may be grasped to selectively slide said sliding jaw member with respect to said body.

8. Locking pliers for grasping an object, comprising:

a body;

a sliding jaw member having a first jaw, said sliding jaw member slidably connected to said body wherein said sliding jaw member may be selectively positioned with respect to said body;

a rotating jaw member having a handle portion and an integral second jaw, said rotating jaw member rotatably connected to said body;

a locking handle rotatably connected to said body;

said rotating jaw member and said locking handle combining to form an over center mechanism;

wherein said sliding jaw member may be slidably positioned so that said first jaw and said second jaw contact the object, and then said handle portion of said rotating jaw member and said locking handle are urged together to activate said over center mechanism;

said sliding jaw member having a slot which slidably receives said body;

said body having two spaced pins which slidably engage said slot;

said sliding jaw member having a plurality of positioning teeth;

a pawl rotatably connected to said body;

said pawl movable between an engaged position wherein said pawl enters a space between two of said plurality of teeth and a disengaged position;

said pawl biased toward said engaged position;

said rotating jaw member including a release stop;

wherein said rotating jaw member is rotationally biased so that said release stop contacts said pawl and urges said pawl into said disengaged position;

when said handle portion of said rotating jaw member and said locking handle are urged together, said rotating jaw member rotating so that said release stop disengages from said pawl thereby allowing said pawl to move to said engaged position; and, said sliding jaw member including a handle which may be grasped to selectively slide said sliding jaw member with respect to said body.

9. A method for grasping an object, including:

(a) providing an object;

(b) providing locking pliers including:

a body;

a sliding jaw member having a first jaw, said sliding jaw member slidably connected to said body, said sliding jaw member having a handle wherein said handle may be used to selectively position said sliding jaw member with respect to said body;

a rotating jaw member having an integral second jaw, said rotating jaw member rotatably connected to said body;

a locking handle rotatably connected to said body; and, said rotating jaw member and said locking handle combining to form an over center mechanism;

(c) grasping said handle of said sliding jaw member with one hand and said rotating jaw member with the other hand;

(d) sliding said sliding jaw member with respect to said body so that said first and second jaws contact said object; and, (e) urging said handle portion of said rotating jaw member and said locking handle together wherein said over center mechanism is activated.

* * * * *